US008371956B2

(12) United States Patent
Walls

(10) Patent No.: US 8,371,956 B2
(45) Date of Patent: Feb. 12, 2013

(54) LIGHTWEIGHT GOLF GRIP

(75) Inventor: Alex Lee Walls, Laurinburg, NC (US)

(73) Assignee: Eaton Corporation, Cleveland, OH (US)

( * ) Notice: Subject to any disclaimer, the term of this patent is extended or adjusted under 35 U.S.C. 154(b) by 153 days.

(21) Appl. No.: 12/635,841

(22) Filed: Dec. 11, 2009

(65) Prior Publication Data

US 2011/0143853 A1 Jun. 16, 2011

(51) Int. Cl.
*A63B 53/14* (2006.01)

(52) U.S. Cl. ..... 473/303

(58) Field of Classification Search ..... 473/300–303, 473/297

See application file for complete search history.

(56) References Cited

U.S. PATENT DOCUMENTS

| | | | | |
|---|---|---|---|---|
| 2,133,696 | A * | 10/1938 | Hall | 473/299 |
| 2,772,090 | A * | 11/1956 | Brandon | 473/301 |
| 3,366,384 | A * | 1/1968 | Lamkin et al. | 473/300 |
| 3,964,340 | A * | 6/1976 | Antonio et al. | 74/551.9 |
| 5,575,473 | A * | 11/1996 | Turner | 473/298 |
| 6,308,590 | B1 * | 10/2001 | Berto | 74/551.8 |
| 6,561,058 | B1 * | 5/2003 | Steinke | 74/551.9 |
| 6,666,777 | B1 * | 12/2003 | Lamkin et al. | 473/300 |
| 6,971,959 | B1 * | 12/2005 | Lu | 473/302 |
| 7,407,444 | B2 | 8/2008 | Cera | |
| 7,931,544 | B2 * | 4/2011 | Gill | 473/300 |
| 2003/0186759 | A1 * | 10/2003 | Buchanan | 473/297 |
| 2008/0113826 | A1 * | 5/2008 | Lin | 473/302 |
| 2009/0124408 | A1 * | 5/2009 | Schroder | 473/318 |
| 2009/0209371 | A1 * | 8/2009 | Tremulis et al. | 473/409 |

FOREIGN PATENT DOCUMENTS

| | | | |
|---|---|---|---|
| EP | 1927439 | B1 | 9/2009 |
| GB | 1048123 | A | 11/1966 |
| GB | 1194124 | A | 6/1970 |
| GB | 1356971 | A | 6/1974 |

* cited by examiner

*Primary Examiner* — Stephen L. Blau
(74) *Attorney, Agent, or Firm* — Daphne L. Burton; Burton IP Law Group

(57) ABSTRACT

A golf grip apparatus includes a pre-molded cap that is fixedly attached to a molded outer sleeve. The golf grip is adapted to be mounted onto the proximal end of a golf club shaft. The golf grip may be permanently mounted onto the golf club shaft, with the outer sleeve of the grip being disposed around the outer circumference of the golf club shaft and the pre-molded cap of the grip being disposed at the most proximal end of the shaft. The outer sleeve may have a predetermined wall thickness that is sufficiently thin to provide a hollow area between the grip's outer sleeve and the club's shaft, when the grip is in use, thus reducing the weight of the grip. Spacers may be created on the inner surface of the grip so that when the grip is mounted onto a shaft, the spacers may assist in maintaining the position of the golf club shaft in the grip.

4 Claims, 6 Drawing Sheets

LIGHTWEIGHT GOLF GRIP

BACKGROUND OF THE INVENTION

1. Field of Invention

The present disclosure relates generally to hand grips and, more particularly to a lightweight golf grip apparatus.

2. Description of Related Art

Many types of hand and sports grips are available on the market today for a wide variety of activities. Such hand/sports grips may be used to reduce impact shock that may be imparted to the human body, including impact shock associated with the use of striking instruments. Examples of such striking instruments range from jackhammers to tennis rackets. Among the numerous other tools or devices that may be categorized as striking instruments are those used in sports such as squash, racquetball and golf. In each of these sports, a player hits a ball with the striking instrument—e.g., a racket or club. When the player strikes the ball with the striking instrument, impact shock may be imparted to the player's joints and/or muscle tissue.

Impact shock may be detrimental to the body and may have particular ramifications for those who have suffered from, or are susceptible to, joint or muscle tissue injuries. Included within this group are seniors. There is a need for a golf grip apparatus that reduces impact on joints and muscles.

In addition to injuries, impact shock may cause discomfort to any golfer, regardless of whether or not they are elderly or prone to muscle or joint injury. There is further a need for a golf grip apparatus that is comfortable to use.

Oversized putters are gaining popularity in golf. Because these putters are striking instruments, they represent another opportunity for hand grip usage. In some instances, oversized putters may be favored because they cause a golf ball to move along a straighter course than with smaller putters. Some golfers favor oversized putters over smaller putters when they wish to strike the ball along a straight course. When smaller putters are used under some circumstances which are deemed more suitable for oversized putters, a golfer's wrist may turn or "break" during the stroke. With oversized putters, this turning action may be less likely to occur because the golfer may have a more relaxed grip.

However, because of the large size of oversized putters, they tend to be heavier than standard putters. Accordingly, although some users may wish to use an oversize putter to improve their golf games, they may shy away from such oversized putters because of the heavier weight and size associated with the oversized putters.

There is a need for a golf grip that does not significantly increase the weight of golf clubs, including oversized putters.

BRIEF SUMMARY OF DISCLOSURE

The present disclosure addresses the foregoing deficiencies of the prior art by providing a golf grip apparatus that is lightweight. The golf grip apparatus includes one or more hollow areas. When the grip is mounted onto a shaft, air in the hollow area(s) are displaced by the shaft, thus causing the air to compress. This air provides cushioning and firmness for the golf grip.

In accordance with one embodiment of the present disclosure, a method is provided for cushioning a golf club grip. The method comprises providing a golf grip apparatus, the golf grip apparatus includes an elongated, substantially conical outer sleeve device having a bell end and a cap end, the outer sleeve device further having a cap end opening and a bell end opening, wherein the cap end opening is larger than the bell end opening, and wherein the elongated substantially conical outer sleeve has a wall that is sufficiently thin such that one or more internal hollow areas are defined inside the outer sleeve between the cap end opening and the bell end opening; and wherein the bell end opening includes one or more contact areas configured to be attached to a golf club shaft, and an end cap attached to the cap end opening of the outer sleeve device.

The method further comprises slideably mounting the golf grip apparatus onto the golf club shaft, the shaft thereby displacing and compressing air in the hollow area, thus providing cushioning and firmness for the golf grip apparatus. The method also comprises attaching the contact areas of the golf grip apparatus to the golf club shaft.

In accordance with another aspect of the present disclosure, a lightweight golf grip apparatus is provided. The lightweight golf grip is adapted to be slideably mounted onto a proximal end of a golf club shaft. The grip apparatus comprises an elongated, substantially conical outer sleeve device having a bell end and a cap end, the outer sleeve device further having an opening at its cap end and an opening at its bell end, wherein the cap end opening is larger than the bell end opening, and wherein the elongated substantially conical outer sleeve has a wall that is sufficiently thin such that one or more internal hollow areas are defined inside the outer sleeve between the cap end and the bell end. The lightweight golf grip further comprises an end cap configured to close the cap end opening of the outer sleeve device. The bell end of the outer sleeve has one or more contact areas configured to be attached to at least a portion of the outer surface of the golf club shaft.

In accordance with yet another aspect of the present disclosure, a golf club with a lightweight grip apparatus is provided. The golf club comprises a head, and an elongated shaft. The golf club further comprises a grip apparatus having an elongated, substantially conical outer sleeve device having a bell end and a cap end, the outer sleeve device further having an opening at its cap end and an opening at its bell end, wherein the cap end opening is larger than the bell end opening; and wherein the elongated substantially conical outer sleeve has a wall that is sufficiently thin such that one or more internal hollow areas are defined inside the outer sleeve between the cap end and the bell end; and an end cap attached to the cap end opening of the outer sleeve device. The bell end opening of the outer sleeve has one or more contact areas configured to be attached to at least a portion of the outer surface of the golf club shaft. The golf club further comprises adhesive configured to fixedly attach the one or more contact areas to the golf club shaft.

In accordance with still another aspect of the present disclosure, a method of manufacturing a lightweight golf club grip apparatus is provided. The method comprising the step of molding an end cap from a first moldable material in a first mold. The method also comprises, in a second mold, molding a substantially conical outer surface of an outer sleeve from a second moldable material, the outer surface having a bell end and a cap end, wherein the cap end is larger than the bell end. The method also comprises coring an elongated hollow area into the outer sleeve using a core bar, the hollow area being substantially conical and having the same length as the outer sleeve.

These, as well as other objects, features and benefits will now become clear from a review of the following detailed description of illustrative embodiments and the accompanying drawings.

DETAILED DESCRIPTION OF THE DISCLOSURE

The golf grip apparatus of the present disclosure provides for lightweight golf grips that incorporate lightweight molded rubber parts. The types of rubbers that may be used for the parts include, but are not limited to, ethylene propylene diene monomer (EPDM) rubber compounds, thermoplastic rubbers and/or thermoset rubbers. The golf grips may be used with oversized putters as well as swing golf clubs. It should be understood that while the subject matter of the present disclosure is generally referred to as a golf grip and the subject apparatus is particularly suited as such, it should be readily apparent that the present disclosure is not intended to be limited solely to golf grips, but may also extend to any sports grip or hand grip for a shock imparting instrument.

Figure 1A:
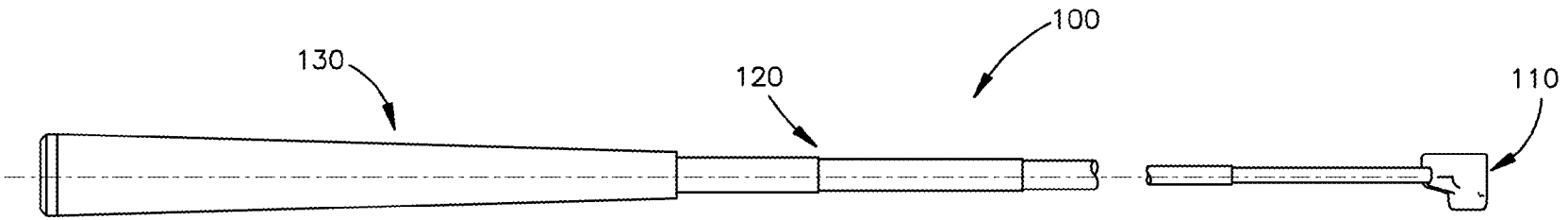
FIGS. 1A-1D illustrate a golf club incorporating a golf grip in accordance with one embodiment of the present disclosure.

The golf grip of the present disclosure may be slideably mounted onto a golf club. Referring now to FIG. 1A, illustrated is a front view of a golf club that includes a golf grip that was slideably mounted onto the proximal end of a golf club shaft. The terms proximal and distal are used herein as they relate to the perspective of a golfer using a golf club that incorporates the present invention. The golf club 100 includes a head 110 disposed at its distal end, and an elongated shaft 120. At the proximal end of elongated shaft 120, from the perspective of the golfer, is the grip apparatus 130.

Figure 1B:
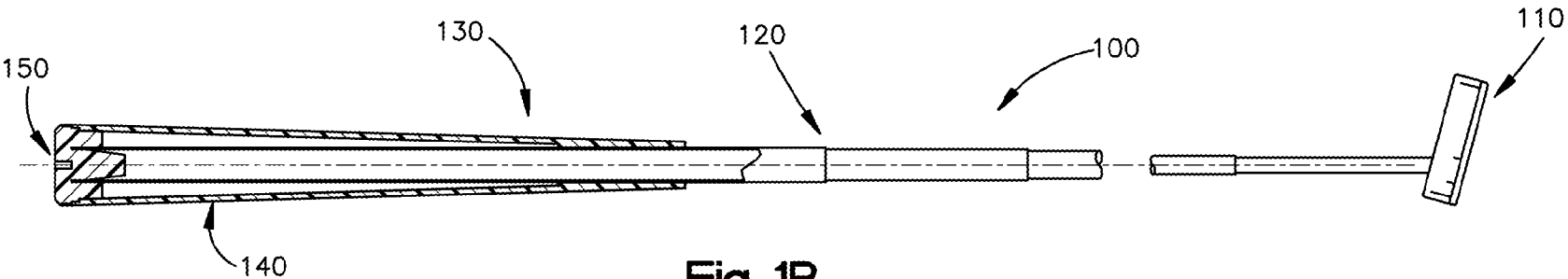
Figures 1C, 1D:
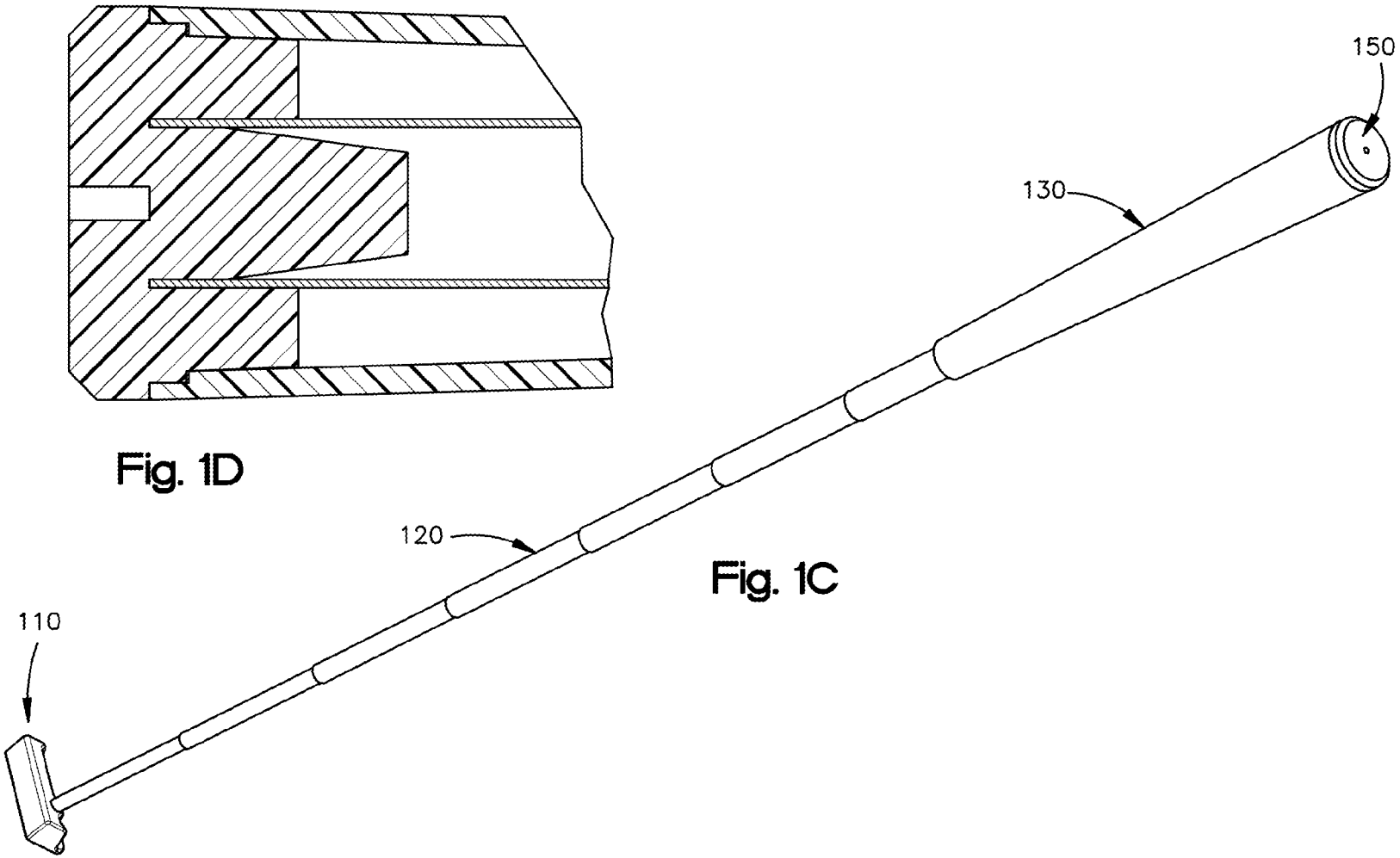

Referring now to FIG. 1B, illustrated is a side cross-sectional view of a golf grip mounted onto a golf club in accordance with one embodiment of the present disclosure. In this cross-sectional view, the outer sleeve 140 and end cap 150 of the golf grip apparatus 130 are visible. FIG. 1D is an exploded view of the cross-section of FIG. 1B.

Referring now to FIG. 1C, illustrated is a perspective view of a golf club that includes a golf grip. This view is similar to the perspective of a golfer, the golf grip 130 and end cap 150 being at the proximal end of the elongated shaft 120.

Figure 2A:
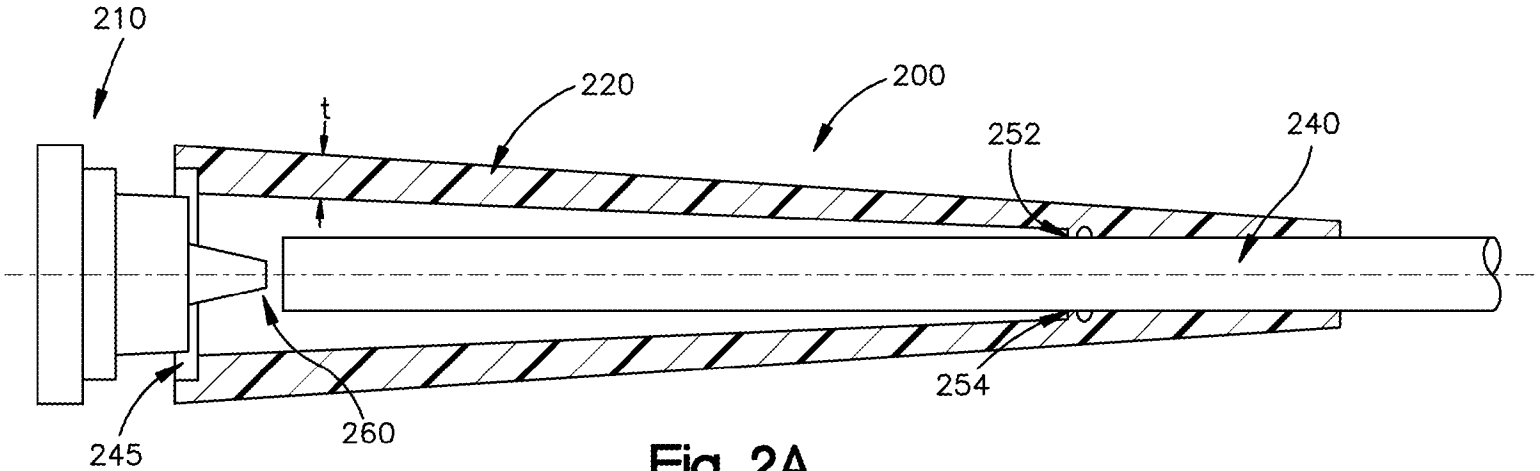
FIG. 2A is a cross section view of an unassembled golf grip apparatus in accordance with one embodiment of the present disclosure.

Referring now to FIG. 2A, illustrated is a cross section view of an unassembled lightweight golf grip apparatus and a golf club shaft in accordance with one embodiment of the present disclosure. As shown, the golf grip apparatus 200 comprises a pre-molded cap 210 disposed at the proximal end of the shaft 240. The main body of the apparatus 200 includes an outer sleeve 220 configured to be attached to the pre-molded cap 210. Pre-molded cap 210 has three annular rings and a notch. The first annular ring is the outermost part of end cap 210 and may be visible when the shaft is assembled. A seat 245 disposed around the perimeter of the proximal end of outer sleeve 220 permits the second annular ring of the pre-molded cap 210 to be seated in the outer sleeve 220, when the grip apparatus 200 is assembled. The third annular ring at the distal end of end cap 210 near the notch may be attached to the inner surface of the wall of outer sleeve 220 when the golf grip is assembled. Adhesive or other attachment means may be used to attach the second and third annular rings to the outer sleeve 220.

The interior compartment of the outer sleeve 220 is configured to receive golf club shaft 240. The golf grip 200 may be slideably mounted onto the golf shaft by sliding the outer sleeve 220 over the shaft 240, and continuing to slide the grip 200 over the shaft 240 until the notch at the distal end of end cap 210 comes into contact with the top of the proximal end of the shaft 240. After the grip apparatus is mounted onto shaft 240, grip 200 may be secured to shaft 240 by an adhesive, tape, or combination thereof. Golf grip 200 may not be reusable since grip 200 may need to be cut away from shaft 240 after use due to the manner in which the grip 240 has been adhered to the shaft 120.

The outer sleeve 220 has a pre-determined wall thickness (t), the wall being sufficiently thin such that a hollow section 260 is provided between the received golf club shaft 240 and the outer sleeve 220. Factors in determining the thickness of the wall may be a thickness that supports the lightest achievable weight and the optimum feel desired for the grip. Accordingly, the thickness of the outer sleeve 220 may vary. For example, for putter configurations, the thickness may be 0.125-0.200 inches. Sporting regulations may limit the size of the outer diameter of the outer sleeve 220.

Hollow area 260 helps to reduce the weight of the grip apparatus 200. It should be noted that in many golf grips, this section may be a solid mass of material. Air captured within the hollow section 260 helps to maintain a distance between the outer sleeve 220 and the received golf club shaft 240. The captured air also provides cushioning and firmness to the golf grip 200. The types of material used to form the cap 210 or sleeve 220 are lightweight and further assist in reducing the weight of the golf grip 200. Suitable materials for forming the cap 210 and sleeve 220 include, but are not limited to, ethylene propylene diene monomer (EPDM) rubber compounds, thermoplastic rubbers and/or thermoset rubbers.

The outer sleeve 220 of the grip apparatus 200 may be sealed to the golf club's shaft using adhesive at areas of the grip 200 that are in contact with the golf club shaft 240. These contact areas 252, 254 may be coated with an adhesive material, including but not limited to adhesive tape and/or liquid or spray adhesives. For example, two-sided tape may be used as an adhesive. A spray adhesive, e.g., 3M.RTM spray adhesive, may also be used. The adhesive may be applied before or after attaching the grip 200 to shaft 240. However, for ease of use, it may be desirable to apply the adhesive after the grip 200 is mounted onto shaft 240 in order to reduce the chance of contact areas 252, 254 adhering to shaft 240 before the grip 200 is fully mounted.

When the grip apparatus 200, including the end cap 210 and outer sleeve 220, is placed onto golf club shaft 240, a volume of air from the environment is displaced from the hollow section 260. The displaced air is thereby compressed, and may be sealed in hollow section 260 at one end by the pre-molded cap 210 and at the other by the bell end of the grip opening, the bell end having adhesive provided at the various contact areas 253, 254, between the outer sleeve 220 and golf club shaft 240. This air provides cushioning and firmness for the golf grip.

Figure 2B:
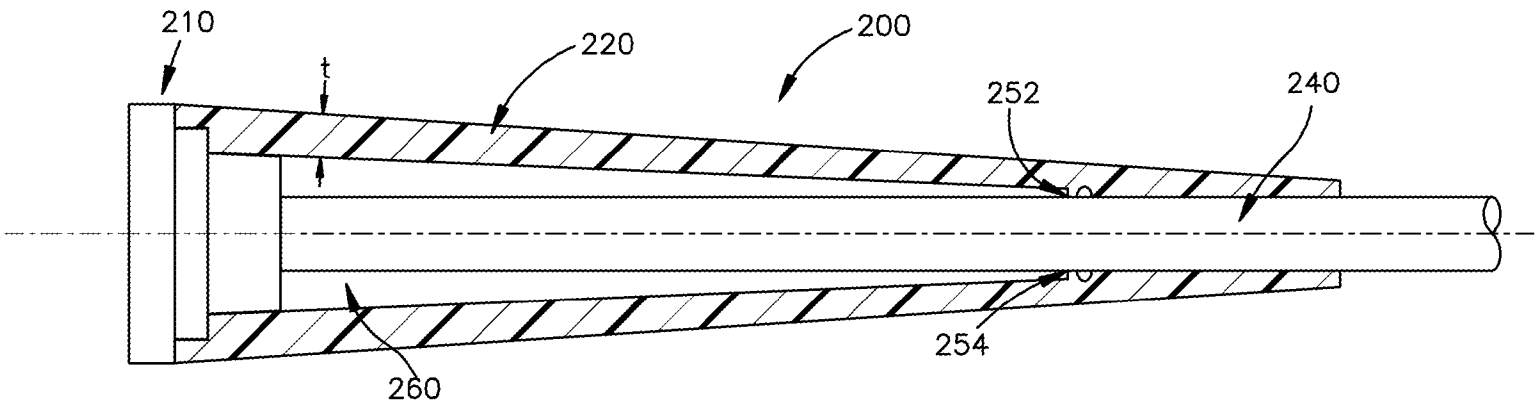
FIG. 2B is a cross section view of an assembled golf grip apparatus in accordance with one embodiment of the present disclosure.

Referring now to FIG. 2B, illustrated is a cross section view of an assembled lightweight golf grip apparatus mounted onto a golf shaft in accordance with one embodiment of the present disclosure. In this illustration, the pre-molded cap 210 has been attached to the outer sleeve 220 using adhesive, e.g., rubber cement. The notched end portion at the distal end of end cap 210 receives the proximal end of golf shaft 240. When the golf grip apparatus is assembled, the first annular ring at the proximal end of the grip 200 is visible from the exterior of the grip apparatus 200 may be seen by the golfer. The second and third annular rings may be joined to the inner surface of the wall of molded outer sleeve 220 with rubber cement or an equivalent type of bonding adhesive. When the grip apparatus 200 is assembled, the second and third annular rings are not visible from the exterior of the grip apparatus 200.

Figure 3:
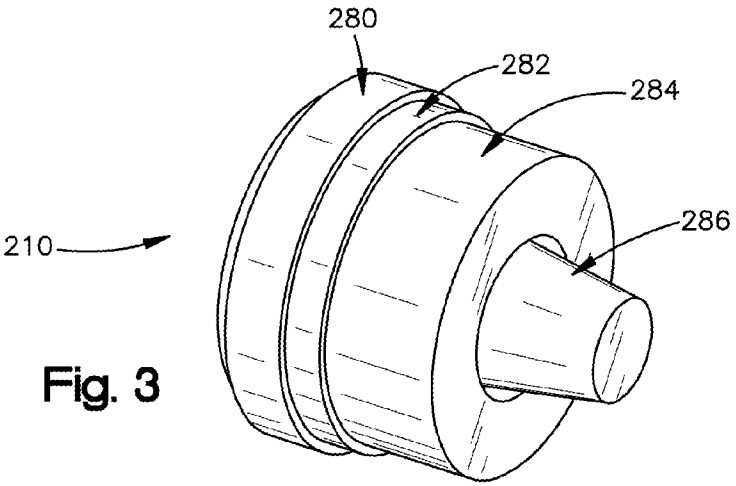
FIG. 3 is a perspective view of an end cap in accordance with one embodiment of the present disclosure.

Referring now to FIG. 3, illustrated is a perspective view of an end cap in accordance with one embodiment of the present disclosure. As shown, the end cap includes three annular rings 280, 282, 284, with the first annular ring 280 having a larger diameter than the second annular ring 282 or the third annular ring 284. The notch 286 on the most distal end of end cap 210 is tapered and may act as a guide during installation of the grip onto a golf club shaft. The third annular ring 284 may provide a seal for the shaft once the grip is installed. The golf club shaft may rest against this third annular ring 284 when the grip is mounted onto a shaft. This third annular ring 284 may also provide stability as it supports the end of the golf club shaft to stay centered on the grip's body.

Figure 4:
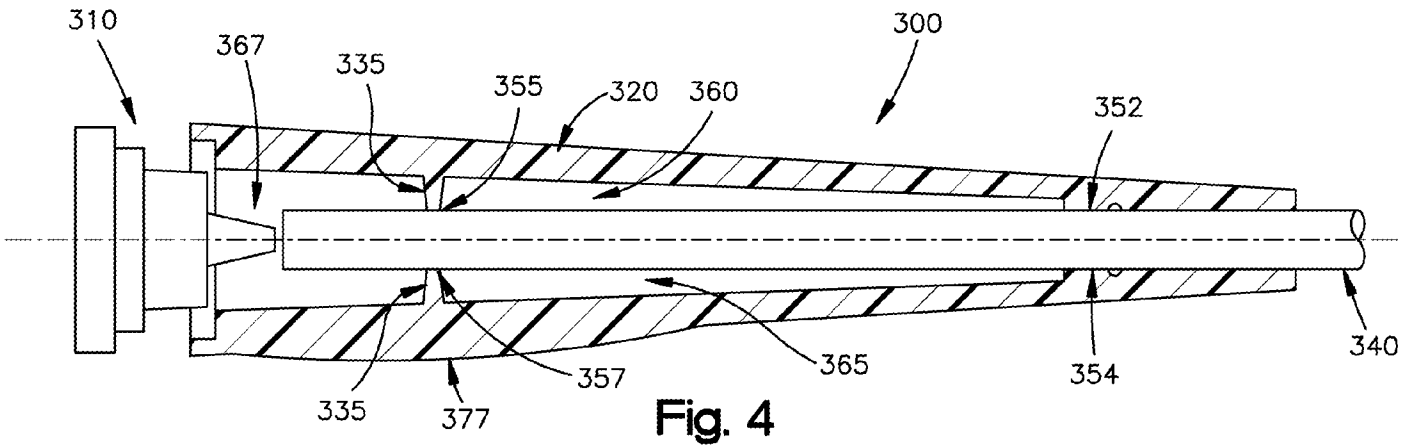
FIG. 4 is a cross-section view of a golf grip apparatus with spacers in accordance with one embodiment of the present disclosure.

In order to assist in maintaining the position of the golf club shaft within the golf grip, the golf grip may include spacers. Referring now to FIG. 4, illustrated is a lightweight golf grip apparatus 300 with one or more spacers in accordance with one embodiment of the present disclosure. In this view, the grip 300 is unassembled. The golf grip of FIG. 4 generally includes the same elements as that of FIGS. 2A and 2B. However, most notably, it includes spacer 335 on the inner surface of the wall of outer sleeve 320. Unlike the grip of FIGS. 2A and 2B, it includes an arch on its outer sleeve 320, which mimics the contour of a putter. This arch illustrates how the design features of the subject golf grip may vary, without departing from the inventive concept. As shown, the golf grip apparatus 300 comprises a pre-molded cap 310 that is configured to be adhered to outer sleeve 320.

The golf grip apparatus 300 may be mounted onto the shaft 340 by slideably placing the outer sleeve 320 over the shaft 340, and continuing to slide the grip 300 over the shaft 340 until the cap 310 comes into contact with the proximal end of the shaft 340.

The outer sleeve 320 has a pre-determined wall thickness (t), the wall being sufficiently thin such that hollow sections 360, 365, 367 are provided between the received golf club shaft 340 and the outer sleeve 320. As noted above, spacer 335 is disposed on the inner surface of the wall for outer sleeve 320. When end cap 310 of golf grip 300 is adhered to the outer sleeve, hollow area 367 is subdivided into two separate hollow sections due to the receipt of the golf shaft by the notched portion of end cap 310.

The outer sleeve 320 of the grip apparatus 300 may be sealed to the golf club's shaft using adhesive at areas of the grip 300 that are in contact with the golf club's shaft 340. These contact areas 352, 354, 355, 357 may be coated with an adhesive material, including adhesive tape and/or liquid or spray adhesives. For example, two-side tape may be used as an adhesive. A spray adhesive, e.g., 3M.RTM spray adhesive, may also be used.

Air may be sealed in the hollow sections 360, 365, 367 at one end by the pre-molded cap and at the other by the bell end of the grip opening which has adhesive provided at the various contact areas 353, 354, 355, 357 between the outer sleeve 320 and golf club shaft 340.

Figure 5:
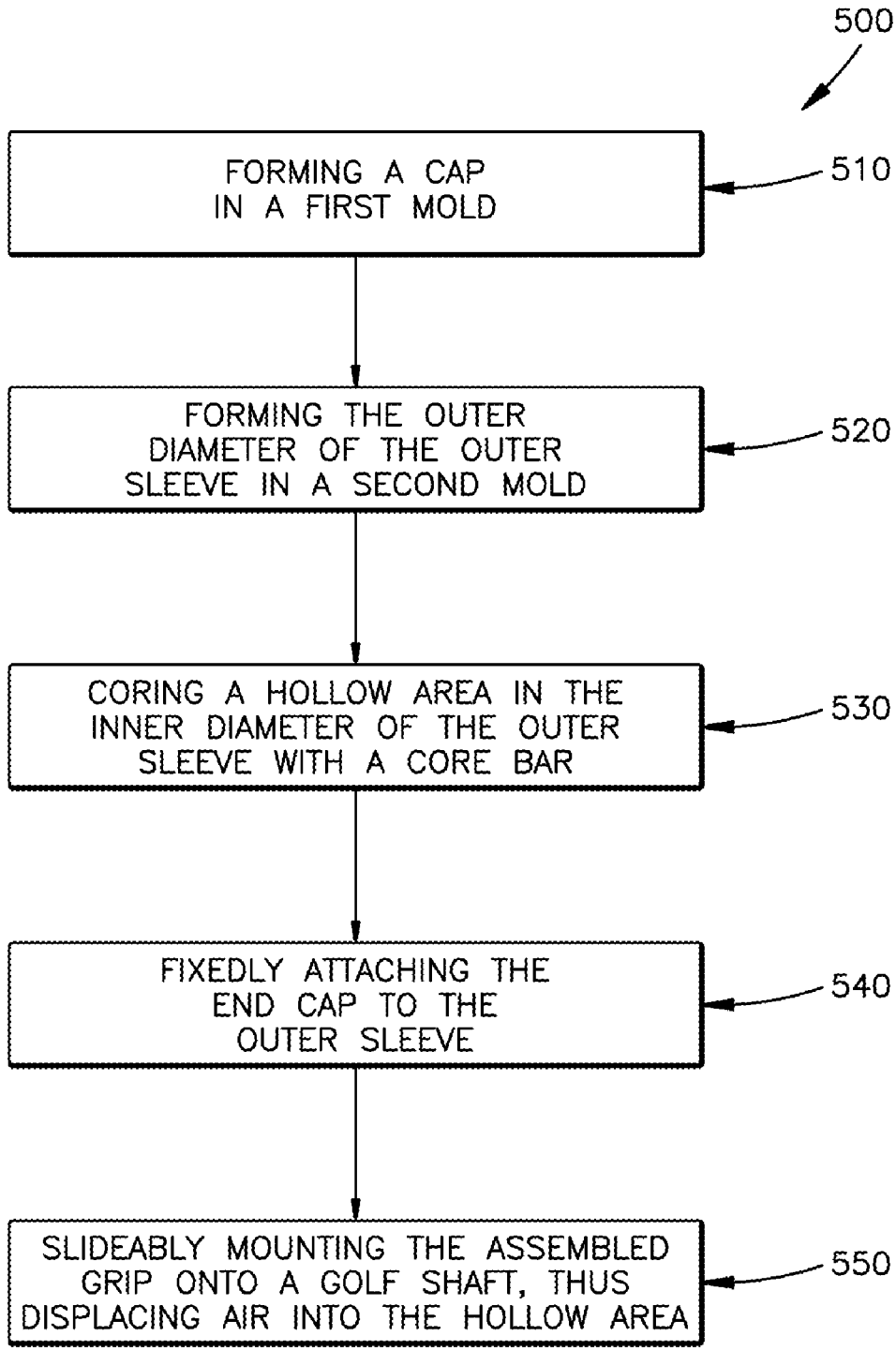
FIG. 5 is a flow diagram of steps for creating the golf grip apparatus of FIGS. 2A and 2B in accordance with one embodiment of the present disclosure.

The manufacturing process for the golf grip of the present disclosure may include the formation of two molds and the formation of an inner surface for the outer sleeve using a core bar. Referring now to FIG. 5, illustrated is a flow diagram 500 showing a method for forming the golf grip of FIG. 5B in accordance with one embodiment of the present disclosure.

At step 510, the golf grip's end cap is formed in a first mold. The components for the end cap may include a first annular ring, a second annular ring, a third annular ring and a notch. The components may be separately molded as four parts and then adhered to each other. Alternatively, the four components may be molded as a single part. At step 520, the golf grip's outer sleeve is formed in a second mold. The outer sleeve may be of such a length as suitable for the desired swing weight or balance of the golf club. Two molds may be desired to form the cap and sleeve because the end cap may be formed from a harder material than the material for the outer sleeve. Though having different hardnesses, the types of rubber used to form the cap or sleeve may include EPDM compounds, TPR or thermoset rubbers. Depending on the type of club being made, the durometer may vary. For example, 30-40 durometers may be targeted for an oversized putter. The two molds may be painted and/or finished as desired.

The internal hollow area or cavity for the outer sleeve could be created using a core bar. The core bar may be inserted into the second mold. Alternatively, the hollow area could be cored out at a later time. This coring step is illustrated at step 530. Using this core bar, the inner surface of the outer sleeve may be cored out to form one or more hollow areas. The hollow areas reduce the weight attributable to the golf grip. Optionally, the core bar may include cutout sections for spacers. After the cap and outer sleeve are formed, optional manufacturing processes may include aesthetic-enhancing processes such as painting and finishing.

At step 540, the pre-molded cap resulting from step 510 may be fixedly attached to the cap end opening of the golf grip. In this manner, the cap and outer sleeve are assembled as a single unit. Two molds were used at steps 510 and 520 because the materials used to form the cap and outer sleeve may have different hardnesses. The cap may be attached in a number of ways. For example, the cap may be attached to the sleeve using adhesive, e.g., rubber cement. Alternatively, the cap may be press fit into the cap end opening of the outer sleeve.

At step 550, the golf grip may be slideably mounted onto the proximal end of the golf club shaft during manufacture or by an end user. It should be understood that the order of steps may vary depending upon whether the grip is assembled at the factory or by the user. When the grip is mounted onto the shaft, a volume of air from the environment that has been trapped in the hollow area is now displaced by the shaft. This air that has been trapped in the hollow area acts to cushion the grip apparatus, meanwhile providing the grip with a certain firmness. A valve may be attached to this hollow area in order to increase or decrease the amount of air in the hollow area, thus providing a desired firmness for the grip.

Figure 6A:
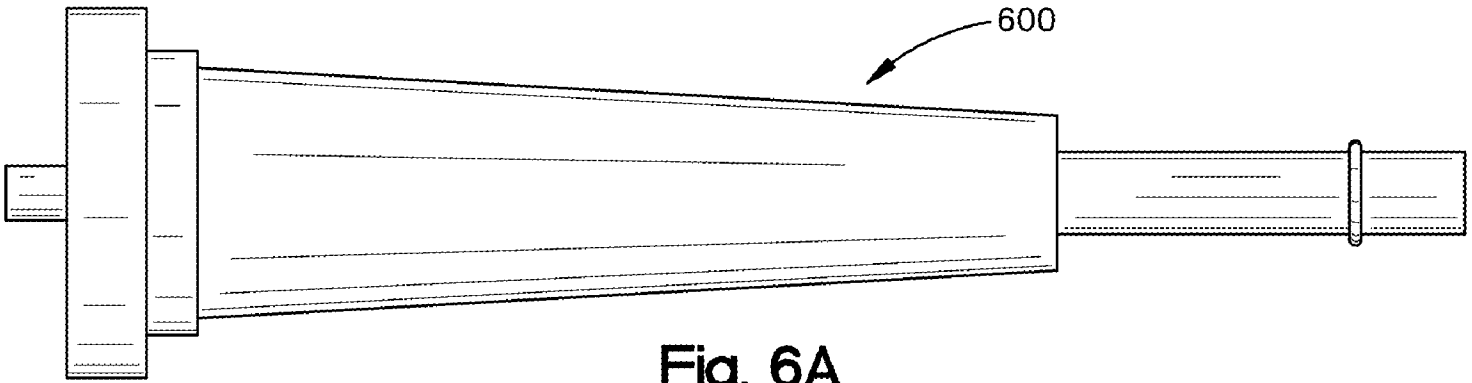
FIG. 6A is a core bar used to form the inner surface of the wall of the outer sleeve of the golf grip of FIGS. 2A and 2B in accordance with one embodiment of the present disclosure.

Referring now to FIG. 6A, illustrated is a core bar used to create the inner surface of the outer sleeve for a golf grip in accordance with one embodiment of the present disclosure. In this embodiment, the core bar does not include spacers. In order to achieve certain swing weights and club balance, the outer diameter and length of the core bar may be varied. The putter may have a size, for example, of D3 thru D6. The swing weight is the pivotal point of balance of the club between the head that comes into contact with the golf ball and grip used to hold the club. When the core bar's outer diameter and length is varied, so is the outer sleeve's inner surface and length since the core bar is used to form the inner surface of the outer sleeve.

Figure 6B:
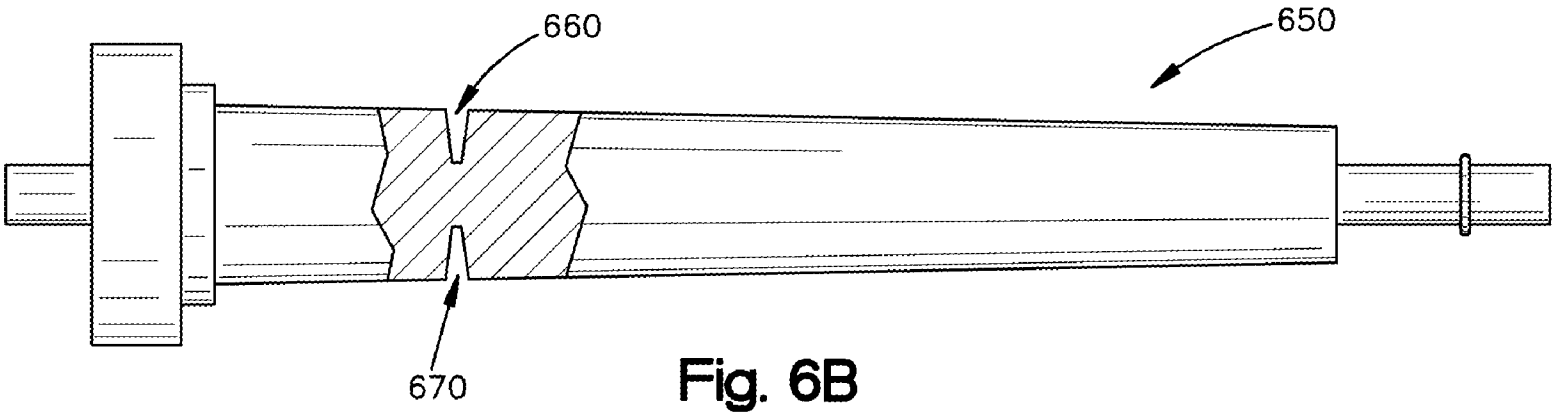
FIG. 6B is a core bar used to form the inner surface of the wall of the outer sleeve of the golf grip of FIG. 4, the core bar having cutout sections for spacers, in accordance with one embodiment of the present disclosure.

Referring now to FIG. 6B, illustrated is a core bar used to create an outer sleeve with spacers in accordance with one embodiment of the present disclosure. As shown this core bar includes cutout sections 660, 670 which are used to create cutout sections from the outer sleeve such as those shown in the golf grip of FIG. 4 hereinabove.

While the specification describes particular embodiments of the present invention, those of ordinary skill can devise variations of the present invention without departing from the inventive concept.

I claim:

1. A lightweight golf grip apparatus adapted to be slideably mounted onto a proximal end of a golf club shaft, the grip apparatus comprising:

an elongated, substantially conical outer sleeve device, the sleeve device having a one-piece molded body, the sleeve device further having a bell end and a cap end, the outer sleeve device further having an opening at its cap end and an opening at its bell end, wherein the cap end opening is larger than the bell end opening, and wherein the elongated substantially conical outer sleeve has a wall that is sufficiently thin such that one or more internal hollow areas are defined inside the outer sleeve between the cap end and the bell end, wherein the one or more hollow areas are configured to capture air; and an end cap configured to close the cap end opening of the outer sleeve device, wherein the end cap has three annular rings, the three annular rings including a middle annular ring disposed between a first annular ring and a second annular ring;

wherein the cap end opening has a seat configured to receive the middle annular ring when the grip apparatus is mounted on the golf club shaft; and wherein the bell end of the outer sleeve has one or more contact areas configured to be attached with an adhesive to at least a portion of the outer surface of the golf club shaft.

2. The golf grip of claim 1, wherein the end cap is composed of a harder material than the outer sleeve material.

3. The golf grip of claim 1, further comprising:

one or more spacers attached to the inner surface of the wall of the outer sleeve, the one or more spacers extending radially inward from the inner surface of the wall of the outer sleeve through the one or more internal hollow areas to contact the outer surface of the golf club shaft.

4. The golf grip of claim 1, wherein the cap further includes a tapered notch.

* * * * *